US011587752B2

(12) United States Patent
Ishikawa et al.

(10) Patent No.: US 11,587,752 B2
(45) Date of Patent: Feb. 21, 2023

(54) ELECTROMAGNETIC RELAY

(71) Applicant: DENSO ELECTRONICS CORPORATION, Anjo (JP)

(72) Inventors: Tomoko Ishikawa, Anjo (JP); Makoto Kamiya, Anjo (JP)

(73) Assignee: DENSO ELECTRONICS CORPORATION, Anjo (JP)

( * ) Notice: Subject to any disclaimer, the term of this patent is extended or adjusted under 35 U.S.C. 154(b) by 0 days.

(21) Appl. No.: 16/935,781

(22) Filed: Jul. 22, 2020

(65) Prior Publication Data

US 2020/0350134 A1 Nov. 5, 2020

Related U.S. Application Data

(63) Continuation of application No. PCT/JP2018/037341, filed on Oct. 5, 2018.

(30) Foreign Application Priority Data

Jan. 31, 2018 (JP) ..... JP2018-015154

(51) Int. Cl.
*H01H 50/54* (2006.01)
*H01H 50/36* (2006.01)
*H01H 50/44* (2006.01)

(52) U.S. Cl.
CPC ..... *H01H 50/546* (2013.01); *H01H 50/36* (2013.01); *H01H 50/44* (2013.01)

(58) Field of Classification Search
CPC ..... H01H 50/36; H01H 50/44; H01H 50/546; H01H 1/54; H01H 50/18; H01H 50/30; H01H 50/34; H01H 50/38; H01H 50/54; H01H 9/443
See application file for complete search history.

(56) References Cited

U.S. PATENT DOCUMENTS

2005/0190025 A1* 9/2005 Yamamoto ..... H01H 50/546 335/128
2013/0049906 A1* 2/2013 Inagaki ..... H01H 50/305 335/189

(Continued)

FOREIGN PATENT DOCUMENTS

JP 2017084613 A 5/2017
JP 2018014173 A 1/2018
WO WO-2016047020 A1 * 3/2016 ..... H01H 50/36

*Primary Examiner* — Bernard Rojas
(74) *Attorney, Agent, or Firm* — Harness, Dickey & Pierce, P.L.C.

(57) ABSTRACT

An electromagnetic relay includes a movable element, a movable yoke, a fixed yoke, a movable section, and a stopper. The movable element includes a movable contact point. The movable yoke is connected to the movable element to move together with the movable element. The movable section includes a movable core made of an inorganic magnetic material and a shaft made of an inorganic material. The fixed yoke is made of an inorganic magnetic material and disposed between the movable core and the movable yoke. The stopper protrudes from either one of the fixed yoke or the movable section toward the other to contact with the other when the movable section moves toward the fixed yoke. The stopper is integrally formed with the either one of the fixed yoke or the movable section.

15 Claims, 6 Drawing Sheets

(56) References Cited

U.S. PATENT DOCUMENTS

| | | | | |
|---|---|---|---|---|
| 2013/0335176 | A1* | 12/2013 | Lee | H01H 51/00 335/187 |
| 2015/0048908 | A1* | 2/2015 | Isozaki | H01H 71/10 335/6 |
| 2015/0194284 | A1* | 7/2015 | Uruma | H01H 9/443 335/179 |
| 2016/0155592 | A1* | 6/2016 | Ito | H01H 50/56 335/187 |
| 2017/0301497 | A1 | 10/2017 | Tanaka et al. | |
| 2018/0350542 | A1 | 12/2018 | Tanaka et al. | |
| 2019/0148094 | A1 | 5/2019 | Mizuno et al. | |
| 2019/0221392 | A1* | 7/2019 | Nishiguchi | H01H 50/443 |

* cited by examiner

ELECTROMAGNETIC RELAY

CROSS REFERENCE TO RELATED APPLICATION

The present application is a continuation application of International Patent Application No. PCT/JP2018/037341 filed on Oct. 5, 2018, which designated the U.S. and claims the benefit of priority from Japanese Patent Application No. 2018-015154 filed on Jan. 31, 2018. The entire disclosures of all of the above applications are incorporated herein by reference.

TECHNICAL FIELD

The present disclosure relates to an electromagnetic relay.

BACKGROUND ART

In an electromagnetic relay, a movable core is attracted toward a fixed core against a return spring by an electromagnetic force generated by a coil being energized. In contrast, when the energization to the coil is stopped, the movable core is biased away from the fixed core by the return spring.

SUMMARY

An electromagnetic relay includes a coil, a fixed element, a movable element, a fixed core, a movable section, a movable yoke, a fixed yoke, and a stopper. The coil is configured to generate a magnetic field by being energized. The fixed element includes a fixed contact point made of an electrical conductive material. The movable element includes a movable contact point disposed to face the fixed contact point in a central axis direction of the coil and made of an electrical conductive material. The fixed core is disposed inside the coil and made of a magnetic material. The movable section includes a movable core that is disposed adjacent to the fixed core in the central axis direction and a shaft that is connected to the movable core and extends toward the movable element in the central axis direction. The movable core is a rigid body made of an inorganic magnetic material and the shaft is a rigid body made of an inorganic material. The movable section is disposed between the movable element and the fixed core to move the movable element in the central axis direction in accordance with an energizing state of the coil. The movable yoke is connected to the movable element to move together with the movable element in the central axis direction and made of a magnetic material. The fixed yoke is disposed between the movable core and the movable yoke and made of an inorganic magnetic material to generate a yoke attracting force between the movable yoke and the fixed yoke when the movable contact point and the fixed contact point are in contact with each other to be energized. The fixed yoke is a rigid body. The stopper protrudes from either one of the fixed yoke or the movable section toward the other to be in contact with the other when the movable core moves toward the fixed yoke. The stopper is integrally formed with the either one of the fixed yoke or the movable section.

DESCRIPTION OF EMBODIMENTS

Figure 1:
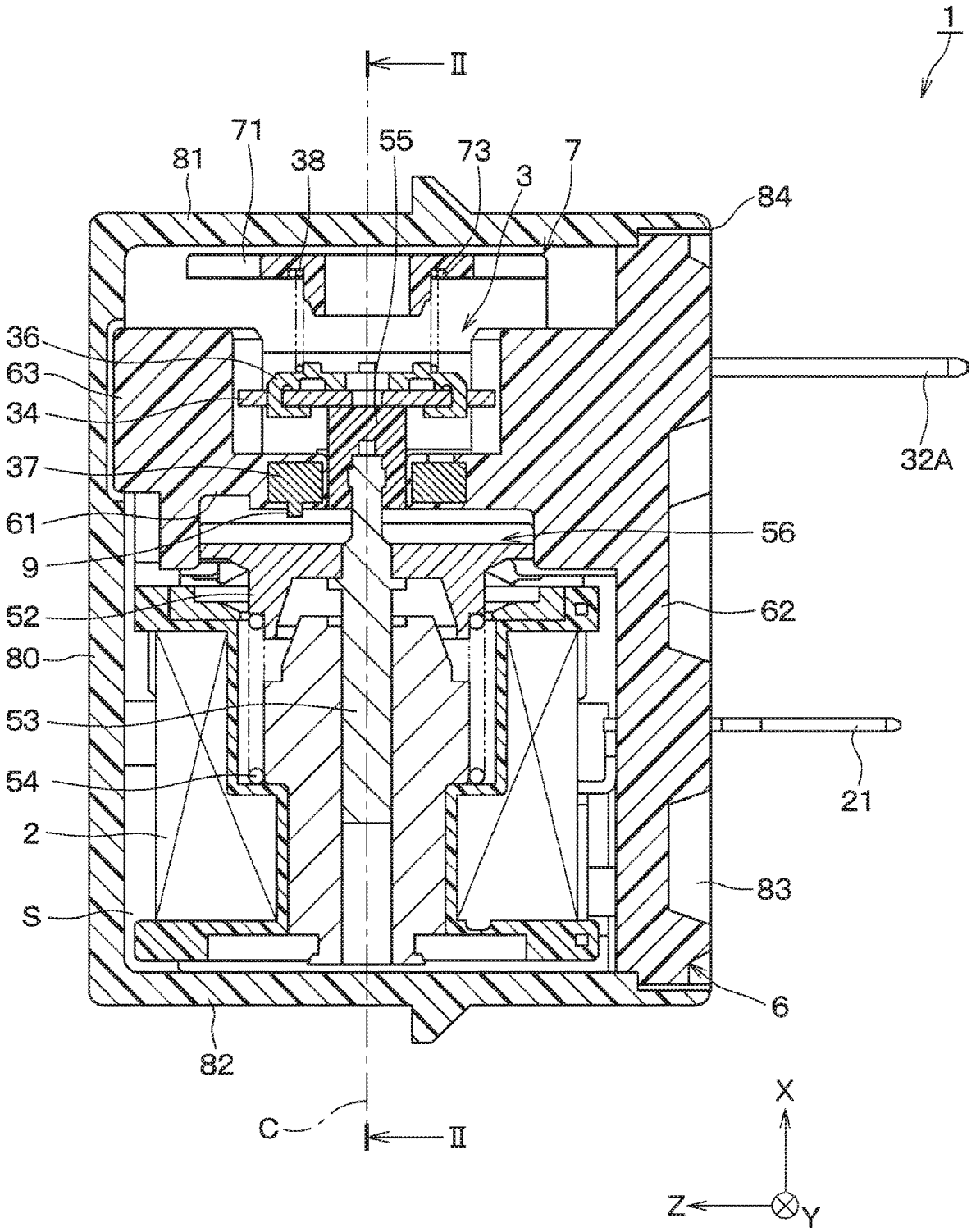
FIG. 1 is a cross-sectional view of a schematic configuration of an electromagnetic relay of an embodiment.

To begin with, examples of relevant techniques will be described.

In an electromagnetic relay, a movable core is attracted toward a fixed core against a return spring by an electromagnetic force generated by a coil being energized. In contrast, when the energization to the coil is stopped, the movable core is biased away from the fixed core by the return spring.

In this type of electromagnetic relay, a moving distance of the movable core is usually restricted by being contact with other member located at a position to which the movable core moves. To define or restrict the moving distance, a restricting portion such as a stopper may be disposed at a position to which the movable core moves. The restricting portion may have a function to reduce foreign particles generated by an interference between the movable core and a synthetic resin member supporting the fixed yoke by restricting the interference.

However, in this configuration, the number of members is increased because of the restricting portion such as the stopper. The present disclosure is provided regarding above mentioned condition.

An electromagnetic relay includes a coil, a fixed element, a movable element, a fixed core, a movable section, a movable yoke, a fixed yoke, and a stopper. The coil is configured to generate a magnetic field by being energized. The fixed element includes a fixed contact point made of an electrical conductive material. The movable element includes a movable contact point disposed to face the fixed contact point in a central axis direction of the coil and made of an electrical conductive material. The fixed core is disposed inside the coil and made of a magnetic material. The movable section includes a movable core that is disposed adjacent to the fixed core in the central axis direction and a shaft that is connected to the movable core and extends toward the movable element in the central axis direction. The movable core is a rigid body made of an inorganic magnetic material and the shaft is a rigid body made of an inorganic material. The movable section is disposed between the movable element and the fixed core to move the movable element in the central axis direction in accordance with an energizing state of the coil. The movable yoke is connected to the movable element to move together with the movable element in the central axis direction and made of a magnetic material. The fixed yoke is disposed between the movable core and the movable yoke and made of an inorganic magnetic material to generate a yoke attracting force between the movable yoke and the fixed yoke when the movable contact point and the fixed contact point are in contact with each other to be energized. The fixed yoke is a rigid body. The stopper protrudes from either one of the fixed yoke or the movable section toward the other to be in contact with the other when the movable core moves toward the fixed yoke. The stopper is integrally formed with the either one of the fixed yoke or the movable section.

According to this configuration, the movable section including the movable core moves toward the fixed yoke in accordance with an energizing state of the coil. The stopper is integrally formed with either one of the fixed yoke or the movable section and protrudes toward the other. Accordingly, the stopper contacts with the other one of the fixed yoke or the movable section. Thus, the moving distance of the movable core can be sufficiently restricted without increasing the number of members.

Embodiment

Hereinafter, an embodiment will be described according to the drawings. Some modified examples of the embodiment will be described altogether after description of the embodiment otherwise understanding of the embodiment may be interfered by description of the modified examples in the description of the embodiment.

Configuration

Figure 2:
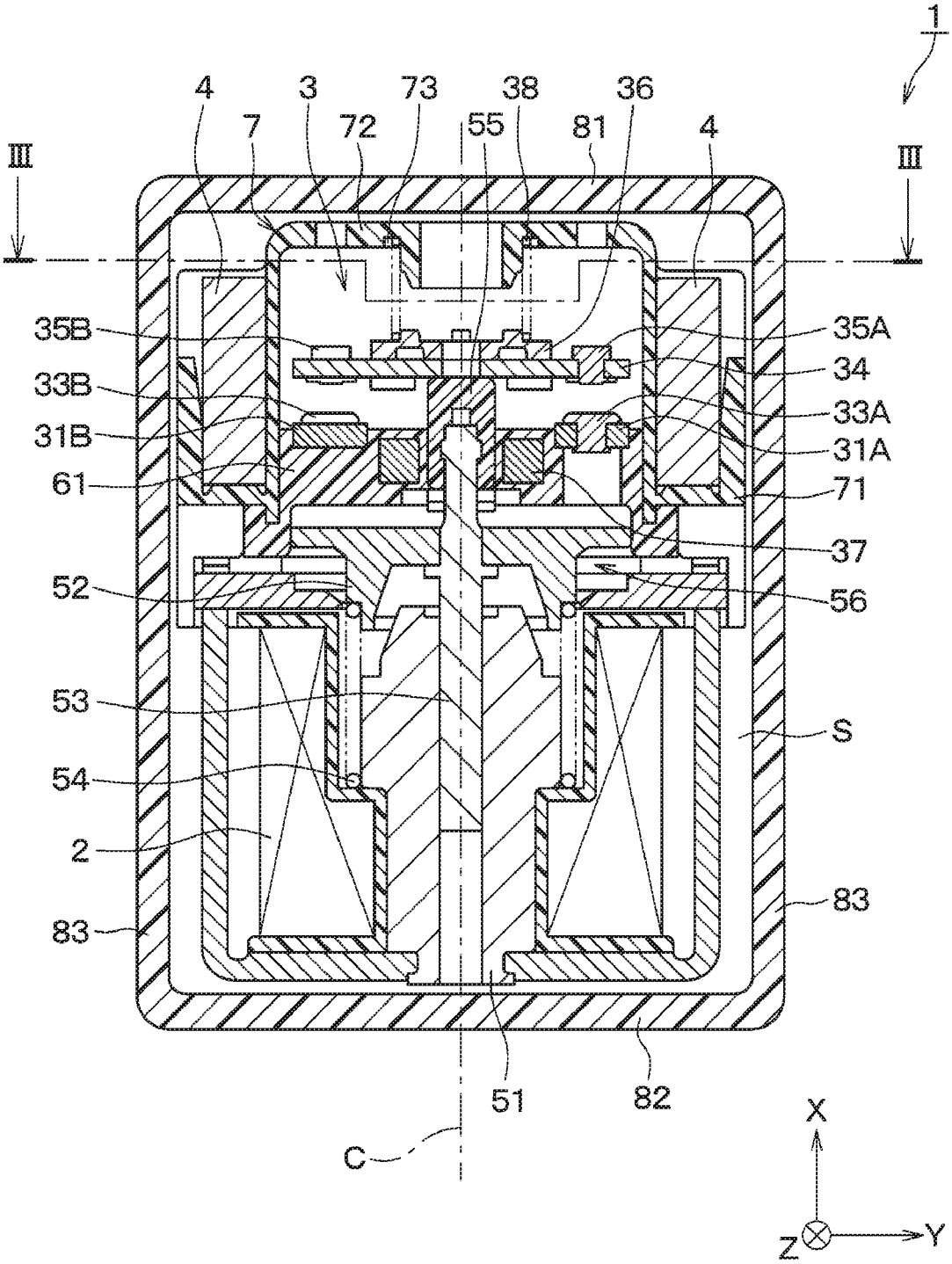
FIG. 2 is a cross-sectional view taken along a line II-II in FIG. 1.
Figure 3:
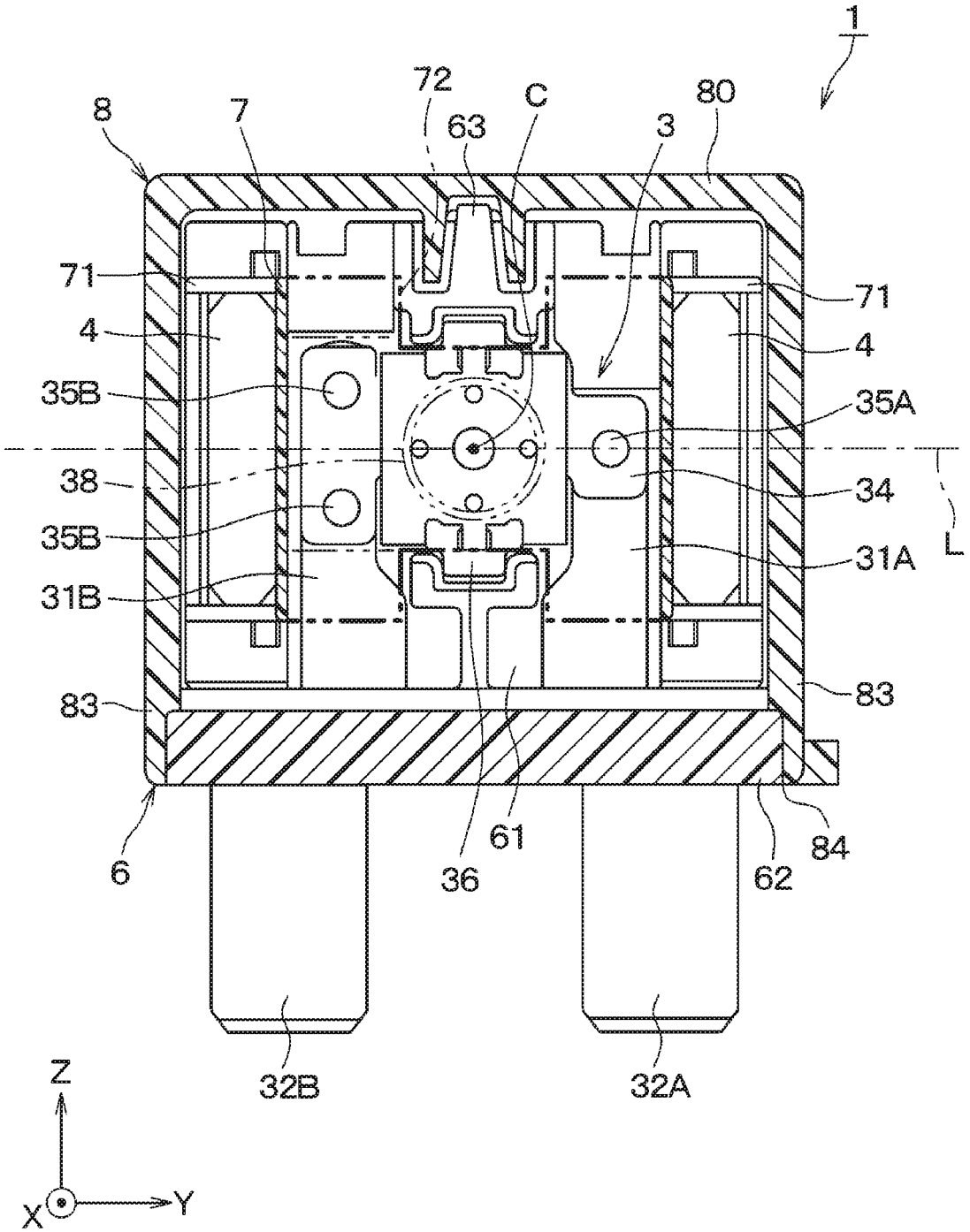
FIG. 3 is a cross-sectional view taken along a line III-III in FIG. 2.

With reference to FIGS. 1 to 3, a configuration of an electromagnetic relay 1 in this embodiment will be described. The electromagnetic relay 1 includes a coil 2, a contact point mechanism 3, permanent magnets 4, a driving section 5, a base frame 6, an intermediate cover 7, an outer cover 8, and a stopper 9. The coil 2, the contact point mechanism 3, the permanent magnets 4, the driving section 5, the intermediate cover 7, and the stopper 9 are housed in a housing space S inside the outer cover 8.

In drawings, a direction parallel with an X axis (i.e., a direction parallel with a central axis C of the coil 2) is referred as a "central axis direction". A Y direction perpendicular to the central axis direction is referred as a "width direction" and a Z direction perpendicular to both of the central axis direction and the width direction is referred as an "element height direction".

In addition, a negative direction of an arrow X is referred as an "attracting direction" and a positive direction of the arrow X is referred as a "return direction". That is, when a direction is parallel with the central axis C and it does not matter whether the direction is the attracting direction or the return direction, the central axis direction is used in following. The central axis direction is also referred as a "contact point open-close direction".

As shown in FIG. 3, a virtual straight line perpendicular to the central axis C and parallel with the width direction is referred as a "center line L". The center line L passes through a point of the central axis C viewed in the central axis direction.

The coil 2 is disposed at an end side in the housing space S in the central axis direction. The end side is a portion that is off centered in the housing space in the attracting direction. An end of the coil 2 in the attracting direction closely faces an inner wall surface of the outer cover 8 in the attracting direction.

The coil 2 configured to generate a magnetic field by being energized is electrically connected to a coil terminal plate 21 fixed to the base frame 6. The coil terminal plate 21 is a metal plate having a tongue shape and extends from the base frame 6 to an outside of the electromagnetic relay 1 in parallel with the element height direction (i.e., a negative direction of an arrow Z).

The contact point mechanism 3 is disposed at a side of the coil 2 in the return direction. Specifically, in this embodiment, the contact point mechanism 3 is disposed at the other end side of the housing space S in the central axis direction. The other end side is off sided in the return direction in the housing space S.

The contact point mechanism 3 is configured to switch an energizing state and a blocking state by being driven by the driving section 5 in accordance with the energizing state of the coil 2. Specifically, the contact point mechanism 3 includes a first fixed element 31A, a second fixed element 31B, a first input output terminal 32A, a second input output terminal 32B, a first fixed contact point 33A, second fixed contact points 33B, a movable element 34, a first movable contact point 35A, second movable contact points 35B, a movable yoke 36, a fixed yoke 37, and a pressing spring 38.

The first fixed element 31A has a tongue shape having a longitudinal direction in the element height direction and a plate thickness direction in the central axis direction. The first fixed element 31A is made of an electrical conductive material. Specifically, the first fixed element 31A has a plate shape made of a metal (e.g., copper). The first fixed element 31A is disposed at a side of the central axis C in a positive direction of an arrow Y.

The first fixed element 31A is integrally and seamlessly formed with the first input output terminal 32A that is a tongue shaped metal plate. The first input output terminal 32A extends from the base frame 6 to the outside of the electromagnetic relay 1 in parallel with the element height direction (i.e., in a negative direction of an arrow Z).

The second fixed element 31B has a tongue shape having a longitudinal direction in the element height direction and a plate thickness direction in the central axis direction. The second fixed element 31B is made of an electrical conductive material. Specifically, the second fixed element 31B has a plate shape made of metal. The second fixed element 31B is disposed at a side of the central axis C in the negative direction of the arrow Y.

The second fixed element 31B is integrally and seamlessly formed with the second input output terminal 32B that is a tongue shaped metal plate. The second input output terminal 32B extends from the base frame 6 to the outside of the electromagnetic relay 1 in parallel with the element height direction (i.e., the negative direction of the arrow Z).

The first fixed element 31A and the second fixed element 31B are arranged in the width direction. The first fixed element 31A and the second fixed element 31B are supported by the base frame 6 made of an electrical insulating material (e.g., synthetic resin) to be electrically insulated from each other in the blocking state. One of the first input output terminal 32A and the second input output terminal 32B is electrically connected to a power and the other is electrically connected to a load (e.g., an electric motor).

The first fixed element 31A includes the first fixed contact point 33A made of an electrical conductive material. The first fixed contact point 33A is an electrical contact point member made of metal and has a substantial solid columnar shape having an axis center in parallel with the central axis C. The first fixed contact point 33A is fixed to the first fixed element 31A by, for example, being cramped. In this embodiment, the first fixed element 31A includes the one first fixed contact point 33A. The first fixed contact point 33A is disposed such that the center line L crosses the axis center of the first fixed contact point 33A.

The second fixed element 31B includes the two second fixed contact points 33B made of an electrical conductive material. The second fixed contact points 33B are electrical contact point members made of metal. Each of the second fixed contact points 33B has a substantial solid columnar shape having an axis center in parallel with the central axis C and fixed to the second fixed element 31B by, for example, being cramped. The first fixed contact point 33A and the second fixed contact points 33B are respectively disposed both sides of the central axis C in the width direction. That is, the central axis C is located between the first fixed contact point 33A and the second fixed contact points 33B.

In this embodiment, the second fixed element 31B includes the two second fixed contact points 33B symmetrically disposed with respect to the center line L. The two second fixed contact points 33B are disposed such that a center point of a segment connecting the two second fixed contact points 33B and the axis center of the first fixed contact point 33A are disposed symmetrically with respect to the center line L.

The movable element 34 is made of an electrical conductive material. Specifically, the movable element 34 is a metal plate member having a longitudinal direction in the width direction and a plate thickness direction in the central axis direction. The movable element 34 is located at a side of the first fixed element 31A and the second fixed element 31B in the return direction. That is, the movable element 34 is disposed to face the first fixed element 31A and the second fixed element 31B in the central axis direction. The movable element 34 is configured to move in the central axis direction in accordance with the energizing state of the coil 2.

The movable element 34 includes the first movable contact point 35A made of an electrical conductive material at an end in the longitudinal direction. The movable element 34 includes the second movable contact points 35B made of an electrical conductive material at the other end in the longitudinal direction. The first movable contact point 35A and the pair of second movable contact points 35B are respectively disposed at both sides of the central axis C in the width direction. That is, the central axis C is located between the first movable contact point 35A and the pair of second movable contact points 35B.

The first movable contact point 35A is an electric contact point member that has a substantial solid columnar shape having an axis center in parallel with the central axis C. The first movable contact point 35A is made of metal and fixed to the movable element 34 by, for example, being cramped. The first movable contact point 35A is disposed to face the first fixed contact point 33A in the central axis direction. That is, in this embodiment, the movable element 34 includes one first movable contact point 35A. The first movable contact point 35A and the first fixed contact point 33A overlap with each other when viewed in the central axis direction.

The second movable contact point 35B is an electric contact point member that has a substantial solid columnar shape having an axial center in parallel with the central axis C. The second movable contact point 35B is made of metal and fixed to the movable element 34 by, for example, being cramped. The second movable contact points 35B are disposed to face the second fixed contact points 33B respectively in the central axis direction. That is, in this embodiment, the movable element 34 includes the two second movable contact points 35B. The second movable contact points 35B and the second fixed contact points 33B corresponding with each other overlap when viewed in the central axis direction.

The movable yoke 36 is made of a magnetic material. Specifically, the movable yoke 36 has a plate shape made of a magnetic metal that has a ferromagnetism.

The movable yoke 36 is connected to the movable element 34 to move together with the movable element 34 in the central axis direction. Specifically, the movable element 34 and the movable yoke 36 are connected with stacking with each other.

The fixed yoke 37 is disposed between the coil 2 and the movable yoke 36. The fixed yoke 37 is supported by the base frame 6 at a position near the first fixed element 31A and the second fixed element 31B. Specifically, the fixed yoke 37 is insert molded with the base frame 6 at an inner side of the first fixed element 31A and the second fixed element 31B, i.e., a position closer to the central axis C than the first fixed element 31A and the second fixed element 31B are.

The fixed yoke 37 has a rigid body made of an inorganic magnetic material such that an attracting force is generated between the movable yoke 36 and the fixed yoke 37 in the energizing state. The energizing state is a state in which the first fixed contact point 33A is in contact with the first movable contact point 35A to be energized and the second fixed contact points 33B are in contact respectively with the second movable contact points 35B to be energized. Specifically, the fixed yoke 37 has a plate or block shape made of a magnetic metal that has a ferromagnetism.

The pressing spring 38 is disposed between the intermediate cover 7 and the movable yoke 36 coupled with the movable element 34. The pressing spring 38 is a coil spring and biases the movable element 34 toward the first fixed element 31A and the second fixed element 31B in the attracting direction.

One of the permanent magnets 4 is disposed adjacent to a position at which the first fixed element 31A faces the movable element 34 in the width direction. Another of the permanent magnets 4 is disposed adjacent to a position at which the second fixed element 31B faces the movable element 34 in the width direction. The permanent magnets 4 are mounted on the intermediate cover 7. Specifically, the permanent magnets 4 are supported by the intermediate cover 7 at an outer side surface of the intermediate cover 7. Each of the permanent magnets 4 is disposed to have a magnetic pole direction in parallel with the width direction.

The electromagnetic relay 1 according to this embodiment includes the two permanent magnets 4. That is, the permanent magnets 4 are respectively disposed at both sides of the central axis C in the width direction. Each of the two permanent magnets 4 is disposed such that an S pole faces the central axis C. The two permanent magnets 4 have similar shapes to overlap with each other in the width direction and are disposed at a similar position in the central axis direction and in the element height direction.

The driving section 5 is configured to move the movable element 34 in the central axis direction in accordance with the energizing state of the coil 2. Specifically, the driving section 5 includes a fixed core 51, a movable core 52, a shaft 53, a return spring 54, and a movable insulator 55.

The fixed core 51 is made of a magnetic material and disposed inside of the coil 2. Specifically, the fixed core 51 is a substantial hollow cylindrical shape that is integrally and seamlessly formed by a metal having a ferromagnetism and disposed inside of the coil 2.

The movable core 52 has a rigid body made of an inorganic magnetic material and disposed to be adjacent to and face the fixed core 51 in the central axis direction. Specifically, the movable core 52 is disposed at a side of the fixed core 51 in the return direction. That is, the movable core 52 is configured to be attracted toward the fixed core 51 when the coil 2 is energized. The attracting direction is a direction in which the movable core 52 is attracted toward the fixed core 51 when the coil 2 is energized.

The movable core 52 is a substantial disc shaped member made of a metal having a ferromagnetism. The movable core 52 is fixed at a middle position of the shaft 53 in the longitudinal direction of the shaft 53. That is, the shaft 53 is connected to the movable core 52 to pass through an axial center of the movable core 52.

The shaft 53 is a stick shaped member and has a rigid body made of an inorganic material. Specifically, the shaft 53 is a round stick member made of metal and disposed such that the longitudinal direction is parallel with the central axis direction.

A part of the shaft 53 protruding from the movable core 52 in the attracting direction is housed in a through hole of the fixed core 51 in an axial direction of the fixed core 51 to be movable in the central axis direction. The other part of the shaft 53 protruding from the movable core 52 in the return direction extends toward the movable element 34 in the central axis direction.

As described above, the fixed yoke 37 is disposed between the movable yoke 36 and the movable core 52. The fixed yoke 37 is disposed at a side of the movable core 52 in the return direction, i.e., the fixed yoke 37 is disposed at a side to which the movable core 52 moves when the coil 2 is stopped to be energized.

The return spring 54 is a coil spring disposed to surround the fixed core 51 and the shaft 53 and disposed to bias the movable core 53 in the return direction. The movable insulator 55 made of an insulating material (e.g., synthetic resin) is fixed to an end of the shaft 53 in the return direction to cover the end. The movable insulator 55 is disposed to move the movable element 34 in the return direction by contacting the movable element 34 when the movable core 52 is biased and moved in the return direction by the return spring 54 when the coil 2 is stopped to be energized.

The driving section 5 includes a movable section 56. The movable section 56 is disposed between the movable element 34 and the fixed core 51 to move the movable element 34 in the central axis direction in accordance with the energizing state of the coil 2. In this embodiment, the movable section 56 includes the movable core 52, the shaft 53, and the movable insulator 55.

The base frame 6 is a member to support the coil 2, the contact point mechanism 3, the driving section 5, and the intermediate cover 7. The base frame 6 is formed seamlessly of an insulating material (e.g., synthetic resin). Concretely, the base frame 6 includes a body portion 61, a bottom portion 62, and a guide 63.

The body portion 61 is a thick plate portion extending from the bottom portion 62 in the element height direction (i.e., in a positive direction of an arrow Z). The fixed yoke 37 is supported in the body portion 61. A surface of the body portion 61 facing the movable element 34 in the central axis direction supports the first fixed element 31A and the second fixed element 31B. The body portion 61 defines a thorough hole through which the end of the shaft 53 in the return direction and the movable insulator 55 pass at a portion corresponding to the central axis C.

The bottom portion 62 supports the body portion 61 extending from the bottom portion 62 in the element height direction like a cantilever. The bottom portion 62 is a plate portion having a plate thickness in the element height direction and has a rectangular shape when viewed in the element height direction. A space surrounded by the bottom portion 62 and the outer cover 8 defines the housing space S.

The guide 63 extends from the body portion 61 in the return direction. The guide 63 is formed to guide the movable element 34 to move in the central axis direction.

The intermediate cover 7 is supported by the body portion 61 of the base frame 6 to cover the contact point mechanism 3 from an upper side in FIGS. 1 and 2. Concretely, the intermediate cover 7 includes a pair of magnet supporters 71 facing each other in the width direction and a covered plate portion 72 disposed between the pair of magnet supporters 71. The intermediate cover 7 is made seamlessly of an insulating material (e.g., synthetic resin).

Each of the magnet supporters 71 has a recess recessed in the attracting direction and supports the permanent magnet 4 in the recess. A wall of the magnet supporter 71 that has a thin plate shape and faces the contact point mechanism 3 is connected to an end of the covered plate portion 72 in the return direction. That is, the permanent magnets 4 are disposed to be in contact with an outer surface of the wall having the thin plate shape described above.

The covered plate portion 72 is a plate portion that has a rectangular shape having a plate thickness in the central axis direction. The covered plate portion 72 extends, in the width direction, from the ends of the magnet supporters 71 in the return direction to face the contact point mechanism 3. That is, the intermediate cover 7 has a substantially U shape viewed in the element height direction such that the pair of the magnet supporters 71 are respectively connected to both ends of the covered plate portion 72 in the width direction. The intermediate cover 7 is shaped substantially symmetrical relative to a surface on which the center line C extends and which has the center line L as a normal line.

The covered plate portion 72 includes a spring engagement recess 73 at an inner surface facing the contact point mechanism 3. The spring engagement recess 73 has a substantial ring shape to be engaged with an end of the pressing spring 38 in the return direction.

The outer cover 8 has a bath tab shape that is a rectangular parallelepiped shape having an opening at an entire area of one surface. The outer cover 8 is seamlessly made of an insulating material (e.g., synthetic resin). Concretely, the outer cover 8 includes a top plate 80, a first side plate 81, a second side plate 82, and a pair of third side plates 83.

The top plate 80 has a plane plate shape having a rectangular shape that has a plate thickness in the element height direction. The top plate 80 extends in the central axis direction and in the width direction. The top plate 80 is disposed to face to the bottom portion 62 of the base flame 6 through the contact point mechanism 3.

The first side plate 81 has a plane plate shape formed in a rectangular shape having a plate thickness in the central axis direction and is disposed to be adjacent to and face the covered plate portion 72. That is, the first side plate 81 extends, in the element height direction (i.e., in a negative direction of the arrow Z) from an end of the top plate 80 in the return direction to face the covered plate portion 72.

The second side plate 82 has a plane plate shape formed in a rectangular shape having a plate thickness in the central axis direction and is disposed to face the first side plate 81 through the coil 2 and the contact point mechanism 3. The second side plate 82 extends, in a direction parallel with the element height direction (i.e., a negative direction of the arrow Z), from an end of the top plate 80 in the attracting direction. The second side plate 82 is disposed to be adjacent to and face the end of the coil 2 in the attracting direction.

Each of the third side plates 83 has a plane plate portion having a rectangular shape and has a plate thickness in the width direction. One of the pair of third side plates 83 is connected to respective ends of the top plate 80, the first side plate 81, and the second side plate 82 in the width direction. The other one of the pair of third side plates 83 is connected to respective the other ends of the top plate 80, the first side plate 81, and the second side plate 82 in the width direction.

An opening 84 of the bath tab shape defined by the top plate 80, the first side plate 81, the second side plate 82, and the pair of third side plates 83 faces in the element height direction (i.e., in a negative direction of the arrow Z in figures). The bottom portion 62 of the base frame 6 is attached to the opening 84, so that the outer cover 8 covers the coil 2, the contact point mechanism 3, the permanent magnets 4, the driving section 5, and the intermediate cover 7.

Figure 4:
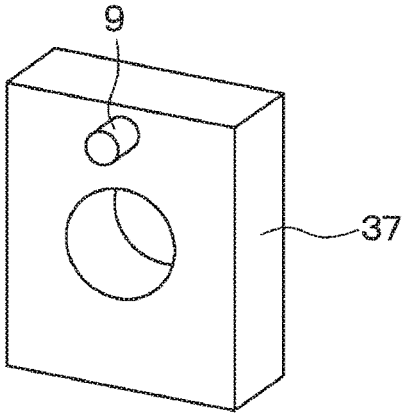
FIG. 4 is a perspective view of an example of a stopper shown in FIG. 1.

The stopper 9 protrudes from either one of the fixed yoke 37 or the movable section 56 toward the other such that the stopper 9 can contact with the other when the movable section 56 moves toward the fixed yoke 37. The stopper 9 is integrally and seamlessly formed with the either one of the fixed yoke 37 or the movable section 56. With reference to FIGS. 1 and 4, in this embodiment, the stopper 9 is a protrusion integrally and seamlessly formed with the fixed yoke 37 and extends toward the movable core 52 in the central axis direction. Concretely, the stopper 9 has a solid columnar shape having a generatrix in parallel with the central axis.

According to the configuration in this embodiment, the movable section 56 including the movable core 52 moves toward the fixed yoke 37 in accordance with the energizing state of the coil 2. The stopper 9 protruding toward the movable core 52 that configures the movable section 56 is integrally formed with the fixed yoke 37. Accordingly, the stopper 9 can contact with the movable core 52. According to this configuration, a moving distance of the movable core 52 can be sufficiently restricted without increasing the number of members.

When the movable core 52 is attracted to the fixed core 51 in response to energization to the coil 2, a position of the movable core 52 in the attracting direction can be defined rapidly with the attracting force. In contrast, when the movable core 52 moves in the return direction with a biasing force of the return spring 54 in response to stopping the energization to the coil 2, a force defining the position of the movable core 52 such as the attracting force is not generated.

Regarding this point, in this embodiment, the fixed yoke 37 is located at a side to which the movable core 52 moves when the energization to the coil 2 is stopped. Thus, the stopper 9 restricts the position of the movable core 52 in the return direction when the movable core 52 moves in the return direction by the biasing force of the return spring 54 when the coil 2 is stopped being energized. Accordingly, the position of the movable core 52 in the return direction can be defined rapidly when the energization to the coil 2 is stopped.

In the configuration of this embodiment, the stopper 9 is a part of the fixed yoke 37 formed by a rigid body made of an inorganic magnetic material. In addition, the movable core 52 that contacts with the stopper 9 is a rigid body made of an inorganic magnetic material.

Thus, foreign particles such as synthetic resin particles are reduced when the position of the movable core 52 is restricted in the return direction by contacting with the stopper 9. Additionally, operating malfunction of the electromagnetic relay 1 caused by the foreign particles are also reduced. A step for positioning of the stopper 9 at a predetermined position is not needed, thereby improving an accuracy of a position of the stopper 9 and reducing the producing cost.

Modified Examples

The present disclosure is not limited to concrete examples described in the above embodiment. The above embodiment can be modified appropriately. Hereinafter, representative modified examples are described. In following description of modified examples, different portions from the above embodiment will be described. The same or equivalent portions between the above embodiment and modified examples are assigned with the same reference numerals. Accordingly, in description of modified examples, the description in the above embodiment can be used for elements having the same reference numerals with the above embodiment unless technical contradictions occur or additional descriptions are made.

The electromagnetic relay 1 may have two first fixed contact points 33A symmetrically disposed at both sides of the center line L, similarly to the second fixed contact points 33B. Alternatively, the electromagnetic relay 1 may have one second fixed contact point 33B on the center line L, similarly to the first fixed contact point 33A. The contact point mechanism 3 may be altered variously and appropriately.

A direction of magnetic pole of the permanent magnets 4 can be altered appropriately. That is, the two permanent magnets 4 may be located such that an N pole of each permanent magnet 4 faces an positive direction of the arrow Y. That is, the pair of permanent magnets 4 may be disposed to face each other at the same pole. The configuration of the driving section 5 is not limited to concrete examples described in the above embodiment.

An opening direction of the recess of the magnet supporter 71 supporting the permanent magnets 4 therein is not limited to the return direction. The opening direction may be the attracting direction or the element height direction.

Figure 5:
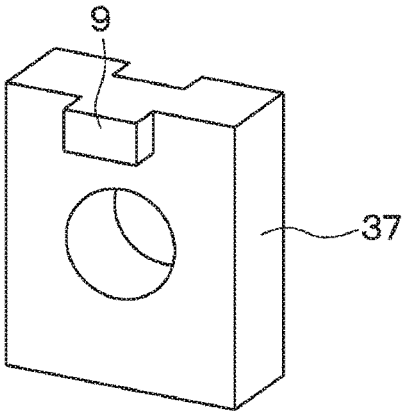
FIG. 5 is a perspective view of an example of a stopper shown in FIG. 1.
Figure 6:
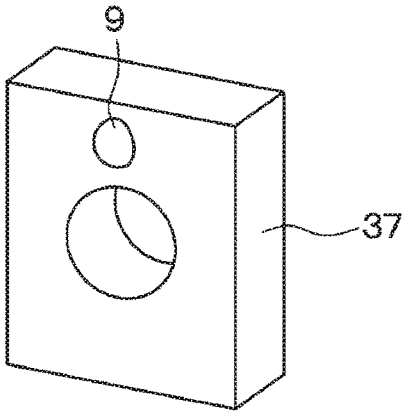
FIG. 6 is a perspective view of an example of a stopper shown in FIG. 1.
Figure 7:
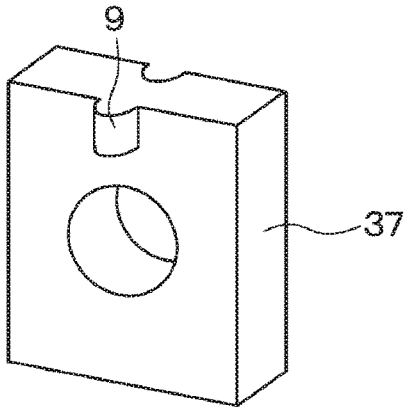
FIG. 7 is a perspective view of an example of a stopper shown in FIG. 1.

A shape of the stopper 9 is not limited to the above concrete example. That is, the stopper 9 may have a circular truncated cone shape. Alternatively, as shown in FIG. 5, the stopper 9 may have a rectangular columnar shape (i.e., quadrangular columnar shape). As shown in FIG. 6, the stopper 9 may have a half sphere shape. As shown in FIG. 7, the stopper 9 may have a half circular pillar shape that has a generatrix perpendicular to an extending direction of the stopper 9.

Figure 8:
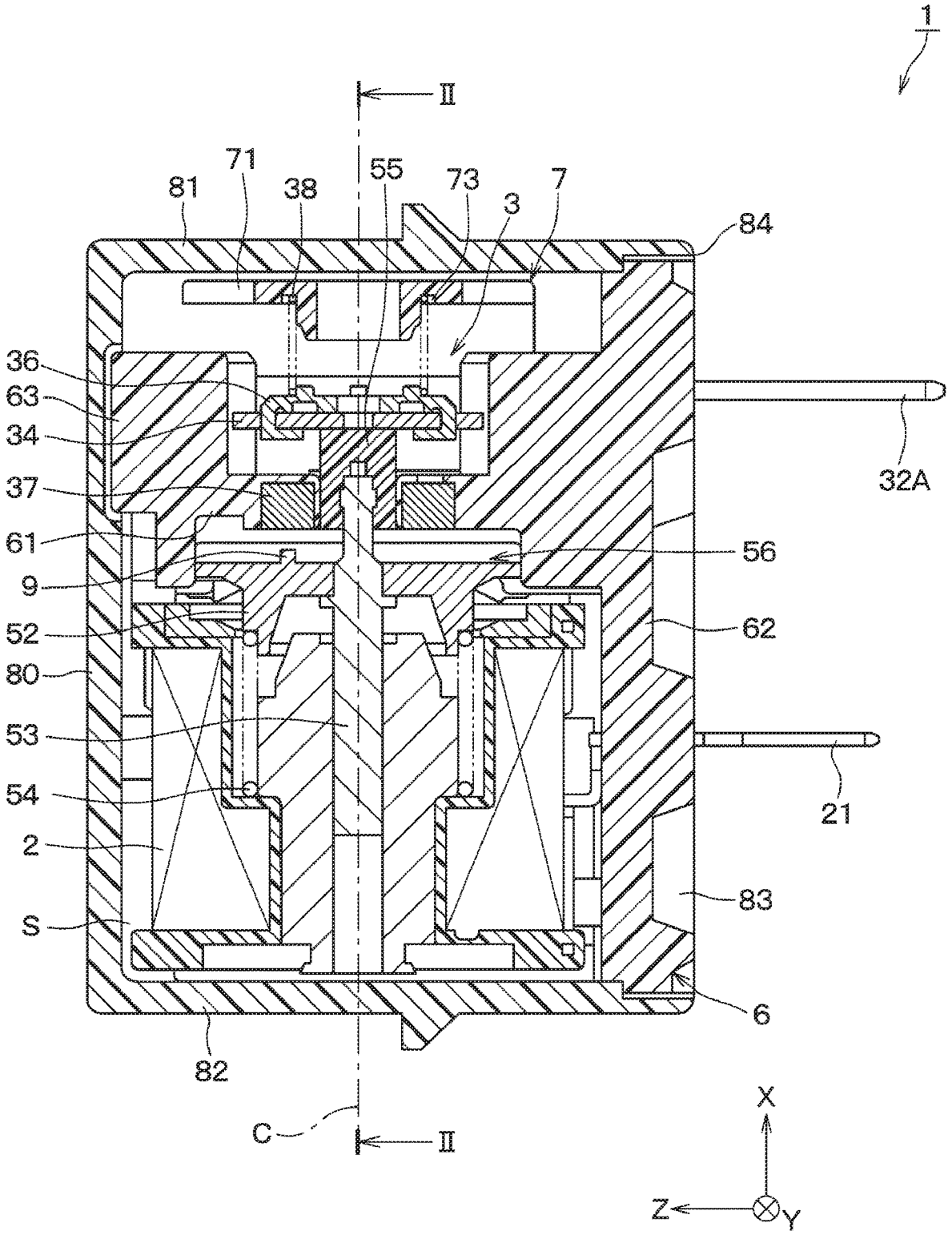
FIG. 8 is a cross-sectional view of a schematic configuration of a modified example of the electromagnetic relay.

The stopper 9 may be disposed at the movable section 56. For example, as shown in FIG. 8, the stopper 9 may be disposed at the movable core 52. Specifically, the stopper 9 is integrally formed with the movable core 52 and extends toward the fixed yoke 37 in the central axis direction. That is, the stopper 9 may be a part of the movable core 52 and seamlessly formed with the movable core 52.

In a configuration of this modified example, the movable section 56 including the movable core 52 moves toward the fixed yoke 37 in accordance with the energization state of the coil 2. The stopper 9 protruding toward the fixed yoke 37 is integrally formed with the movable core 52 configuring the movable section 56. Thus, the stopper 9 disposed at the movable core 52 contacts with the fixed yoke 37. Accordingly, a moving distance of the movable core 52 can be sufficiently restricted without increasing the number of members.

According to this modified example, the stopper 9 is a part of the movable core 52 that is a rigid body made of an inorganic magnetic material. The fixed yoke 37 configured to contact the stopper 9 is also a rigid body made of an inorganic magnetic material.

Thus, foreign particles such as synthetic resin particles are reduced when the position of the movable core 52 is restricted in the return direction by contact between the fixed yoke 37 and the stopper 9 at the movable core 52. Additionally, operating malfunction of the electromagnetic relay 1 caused by the foreign particles are also reduced. A step for positioning the stopper 9 at a predetermined position is not needed, thereby improving an accuracy of a position of the stopper 9 and reducing the producing cost.

Figure 9:
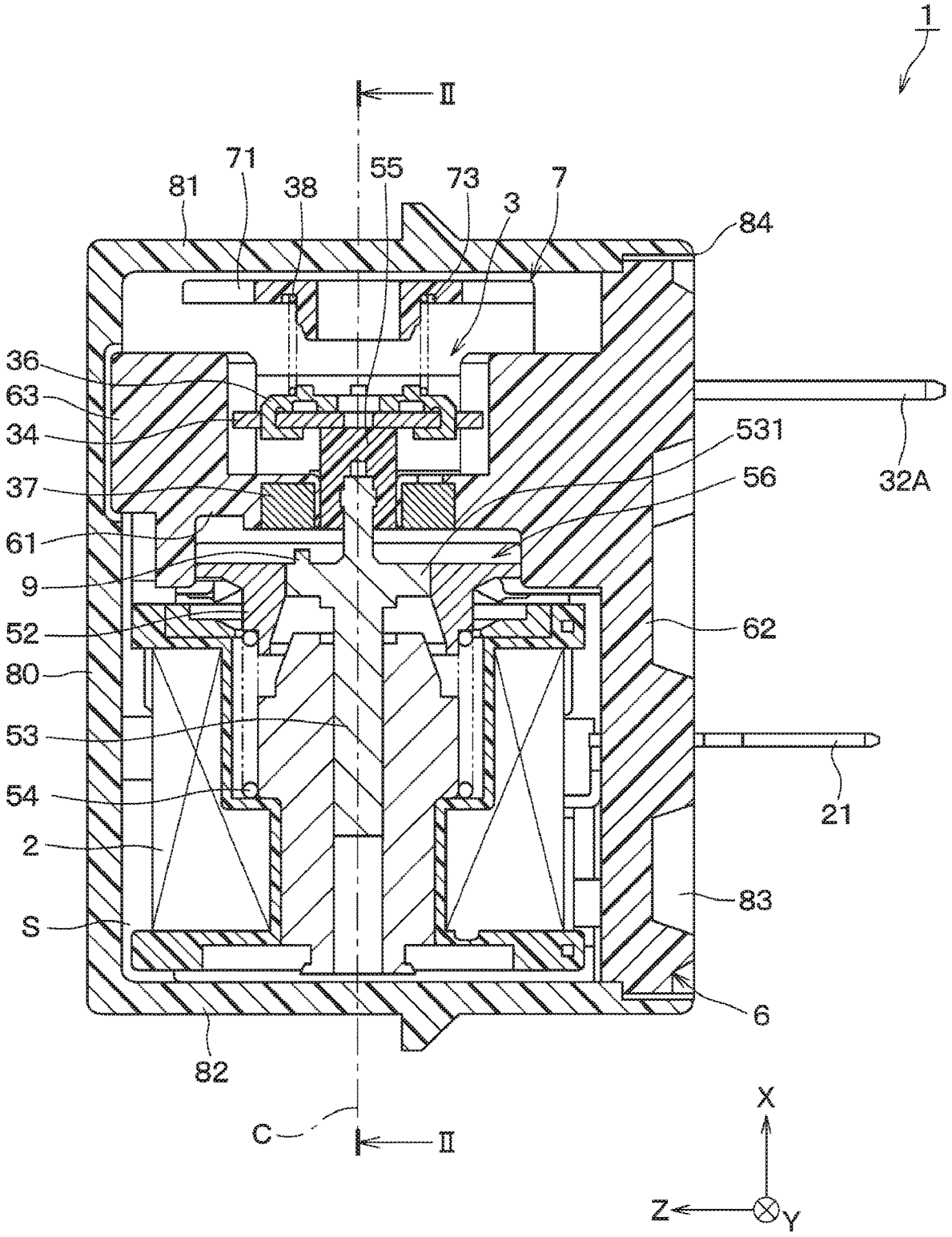
FIG. 9 is a cross-sectional view of a schematic configuration of a modified example of the electromagnetic relay.

As shown in FIG. 9, the shaft 53 may have the stopper 9. Specifically, in this modified example, the shaft 53 includes a flange 531 having a substantial disc shape extending in a radial direction from the central axis C.

The flange 531 faces the fixed yoke 37 in the central axis direction and is connected to the movable core 52. The stopper 9 is integrally formed with the flange 531 and extends toward the fixed yoke 37 in the central axis direction.

In the configuration of this modified example, the movable section 56 including the movable core 52 moves toward the fixed yoke 37 in response to the energizing state of the coil 2. In this case, the stopper 9 protruding toward the fixed yoke 37 is integrally formed with the flange 531 of the shaft 53 configuring the movable section 56. Accordingly, the stopper 9 disposed at the flange 531 of the shaft 53 connected to the movable core 52 can contact the fixed yoke 37. Thus, a moving distance of the movable core 52 can be sufficiently restricted without increasing the number of members.

In the configuration of this modified example, the stopper 9 is a part of the shaft 53 formed of a rigid body made of an inorganic material. The fixed yoke 37 with which the stopper 9 contacts has a rigid body made of an inorganic magnetic material.

Thus, foreign particles such as synthetic resin particles are reduced when the position of the movable core 52 is restricted in the return direction by contact between the stopper 9 and the fixed yoke 37. Additionally, operating malfunction of the electromagnetic relay 1 caused by the foreign particles are also reduced. A step for positioning of the stopper 9 at a predetermined position is not needed, thereby improving an accuracy of a position of the stopper 9 and reducing the producing cost.

A member integrally and seamlessly formed in the above embodiment may be formed with seam by adhesion of multiple members as a whole. That is, the body portion 61 of the base frame 6 may be fixed to the bottom portion 62 with adhesion. Similarly, multiple members connected with each other with seam may be seamlessly formed with each other.

Material for elements are not limited. That is, for example, as described above, the movable insulator 55, the base frame 6, the intermediate cover 7, and the outer cover 8 are typically made of synthetic resin having an insulating property. The electrical conductive element and the ferromagnetic member are typically made of metal. However, the present disclosure is not limited to these embodiments. Moreover, the shaft 53 may be made of material other than metal (e.g., ceramics).

The modified examples are not limited to above descriptions. Multiple modified examples can be combined with each other. Additionally, a part or all parts of the embodiment can be combined with a part or all parts of the modified examples.

It goes without saying that elements configuring the above embodiment and the modified examples are not necessary unless the elements are described to be necessary or obviously necessary in principle. The number of the elements, value, amount, and range are not limited to specified number unless the number of the elements, value, amount, and range are mentioned or clearly described to be limited to the specified number. Similarly, unless shape of the element, a direction, a positional relationship are mentioned or elements are limited to the specified shape, direction, positional relationship in principle.

What is claimed is:

1. An electromagnetic relay comprising:

a coil configured to generate a magnetic field by being energized;

a fixed element including a fixed contact point made of an electrical conductive material;

a movable element including a movable contact point that is made of an electrical conductive material and disposed to face the fixed contact point in a central axis direction of the coil;

a fixed core that is made of a magnetic material and disposed inside the coil;

a movable section disposed between the movable element and the fixed core to move the movable element in the central axis direction in accordance with an energizing state of the coil, the movable section including:

a movable core that is a rigid body made of an inorganic magnetic material and disposed adjacent to the fixed core in the central axis direction; and a shaft that is connected to the movable core and extends toward the movable element in the central axis direction, the shaft being a rigid body made of an inorganic material;

a movable yoke that is made of a magnetic material and connected to the movable element to move together with the movable element in the central axis direction;

a fixed yoke that is a rigid body made of an inorganic magnetic material and disposed between the movable core and the movable yoke to generate a yoke attracting force between the movable yoke and the fixed yoke upon being energized by a contact between the movable contact point and the fixed contact point; and a stopper that protrudes from either one of the fixed yoke or the movable core toward the other to be in contact with the other when the movable section moves toward the fixed yoke, the stopper being integrally formed with the either one of the fixed yoke or the movable core, wherein the stopper is a rigid body and made of an inorganic magnetic material, and the stopper, the fixed yoke, and the movable core are all made of the same inorganic magnetic material.

2. The electromagnetic relay according to claim 1, wherein the fixed yoke is disposed at a side of the movable core, the side to which the movable core moves when the coil is stopped to be energized.

3. The electromagnetic relay according to claim 1, wherein the stopper is integrally formed with the fixed yoke and extends toward the movable core in the central axis direction.

4. The electromagnetic relay according to claim 3, wherein the movable core is disposed between the fixed core and the fixed yoke integrally formed with the stopper.

5. The electromagnetic relay according to claim 1, wherein the stopper is integrally formed with the movable core and extends toward the fixed yoke in the central axis direction.

6. The electromagnetic relay according to claim 1, further comprising a base frame made of an electrical insulating material and supporting the fixed yoke therein, wherein the stopper protrudes from the fixed yoke, and extends beyond the base frame toward the movable core.

7. The electromagnetic relay according to claim 1, wherein the fixed element includes a first fixed element and a second fixed element, the fixed contact portion includes a first fixed contact point and a second fixed contact point, the first fixed element includes the first fixed contact point and the second fixed element includes the second fixed contact point, the first fixed contact point and the second fixed contact point are arranged in a width direction that is perpendicular to an axial direction of the coil, and the stopper is arranged between the first fixed contact point and the second fixed contact point to overlap with the shaft when viewed in a direction perpendicular to both the width direction and the axial direction.

8. The electromagnetic relay according to claim 1, wherein the fixed yoke defines a hole through which the shaft is inserted, the stopper protrudes from the fixed yoke at a position next to the hole not to surround the hole.

9. The electromagnetic relay according to claim 8, wherein the stopper has a cylindrical pillar shape.

10. The electromagnetic relay according to claim 8, wherein the stopper has a prism shape.

11. The electromagnetic relay according to claim 8, wherein the stopper has a semi-sphere shape.

12. The electromagnetic relay according to claim 1, wherein the stopper is seamlessly formed with the fixed yoke and an axis of the stopper is offset from an axis of the shaft.

13. The electromagnetic relay according to claim 1, wherein the stopper is seamlessly formed with the movable core and an axis of the stopper is offset from an axis of the shaft.

14. The electromagnetic relay according to claim 1, wherein the fixed yoke consists of a rectangular plate having four sides, the rectangular plate has a round hole through which the shaft is inserted at a center of the rectangular plate, and the rectangular plate seamlessly has the stopper at a position between the round hole and only one edge of the rectangular plate having the four sides.

15. The electromagnetic relay according to claim 1, wherein the shaft has a flange engaged with the movable core, the stopper is located not to overlap with the flange of the shaft in both the central axis direction and a direction perpendicular to the axis direction, the stopper is seamlessly formed with the fixed yoke or the movable core, and an axis of the stopper is offset from an axis of the shaft.

* * * * *